United States Patent [19]

Gonzales et al.

[11] 4,086,921

[45] May 2, 1978

[54] THERAPEUTIC FOOTREST

[76] Inventors: David Gonzales, 140 Champa St., Vista, Calif. 92083; Keith R. Ewing, 259 Brookside La., Oceanside, Calif. 92054

[21] Appl. No.: 732,525

[22] Filed: Oct. 14, 1976

[51] Int. Cl.[2] ..... A61H 21/00

[52] U.S. Cl. ..... 128/24.2; 128/25 B

[58] Field of Search ..... 128/25 B, 24.2, 33, 128/24.1, 36

[56] References Cited

U.S. PATENT DOCUMENTS

| | | | |
|---|---|---|---|
| 1,709,410 | 4/1929 | Simmons | 128/25 B |
| 2,041,693 | 5/1936 | Boltz et al. | 128/25 B |
| 2,045,814 | 6/1936 | Werler | 128/25 B |
| 2,216,764 | 10/1940 | Clark | 128/25 B |
| 2,345,439 | 3/1944 | Tompkins | 128/25 B |
| 3,392,723 | 7/1968 | Calvin | 128/33 X |
| 3,625,203 | 12/1971 | Wadelton | 128/25 B |
| 3,830,232 | 8/1974 | McNair | 128/33 |

*Primary Examiner*—Lawrence W. Trapp
*Attorney, Agent, or Firm*—Allan M. Shapiro

[57] ABSTRACT

Therapeutic footrest has an upholstered rest cushion which is angularly adjustable by electric remote control, is heated to a remotely controllable temperature, and is vibratable at a frequency which is remotely controllable. An upholstered panel can be raised at the back of the cushion so that the footrest may be used as a seat.

15 Claims, 3 Drawing Figures

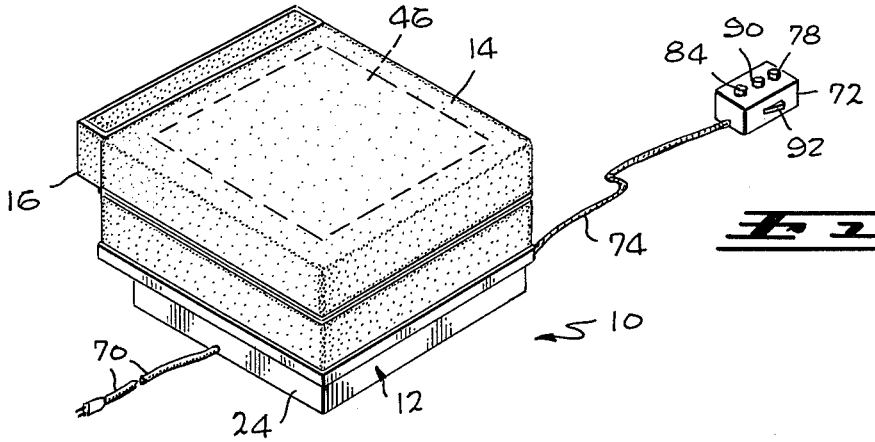
Fig. 1
Fig. 2
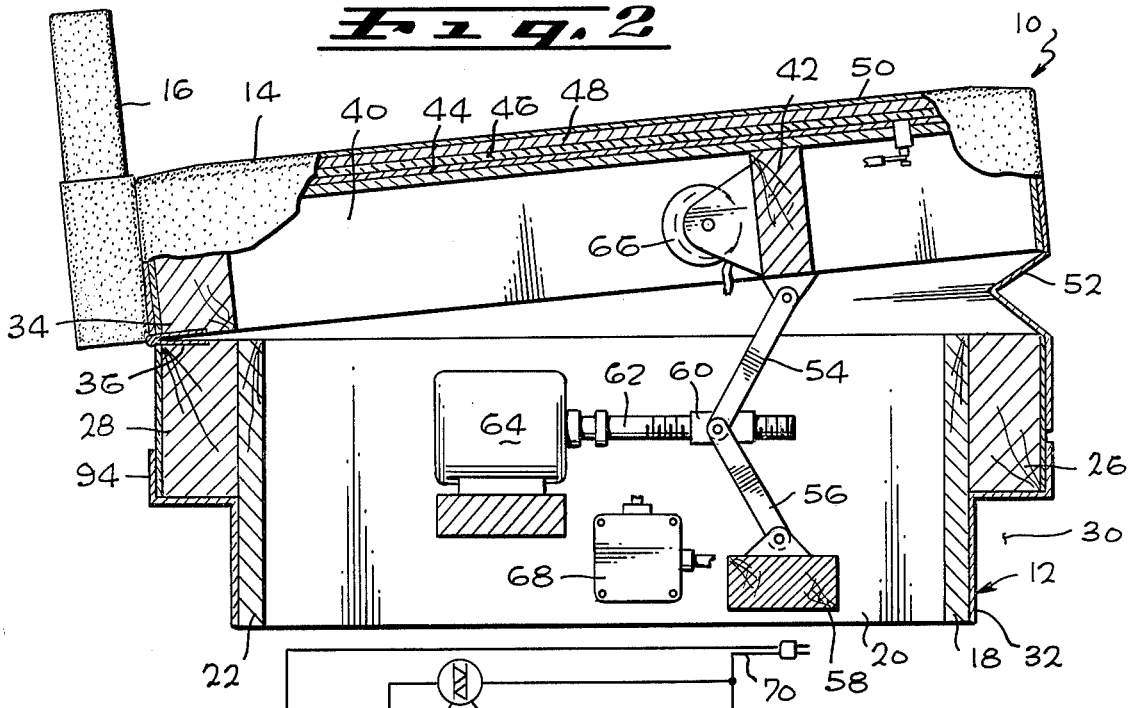
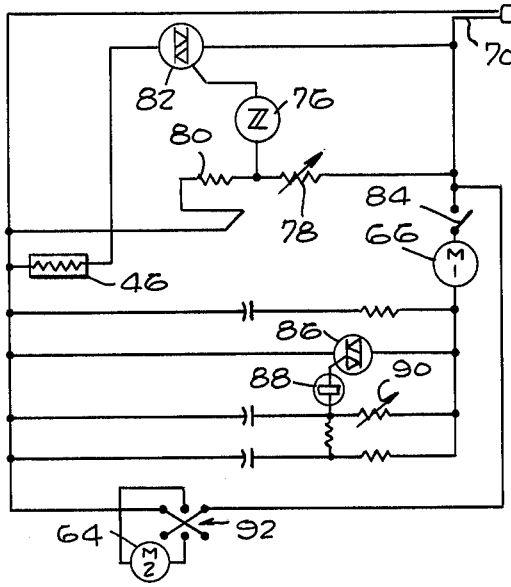
Fig. 3

THERAPEUTIC FOOTREST

BACKGROUND OF THE INVENTION

1. Field of the Invention

This invention is directed toward a therapeutic footrest which has a plurality of comfort-inducing features to rest the user's feet and legs.

2. Description of the Prior Art

A considerable amount of work has been done on footstools, ottomans, and footrests to provide different features which are comfortable or therapeutically desirable. Various features have been designed into prior footrests, each having its desirable result or effect. However, no one has achieved the desirable end of producing a footrest which has a plurality of desirable effects so that they can be enjoyed in combination so that improved results are achieved.

SUMMARY OF THE INVENTION

In order to aid in the understanding of this invention, it can be stated in essentially summary form that it is directed to a therapeutic footrest which includes at least two of the features of an angularly adjustable rest cushion, a heated rest cushion, and a vibrated rest cushion with the features preferably being adjustable from a remote position so that the user can adjust these features while at rest.

It is thus an object of this invention to provide a therapeutic footrest which provides a combination of desirable features. It is another object of this invention to provide a therapeutic footrest which includes angular adjustment of the top rest cushion, controllable heating, and controllable vibration. It is a further object to provide a therapeutic footrest wherein the features are remotely controllable so that the user can adjust them while at rest. It is a further object to provide a therapeutic footrest of combined features so that each of the features is provided in an economic combined structure so that the features can be used independently or in combination. It is a further object to provide a therapeutic footrest which is useful as a seat, including the provision of a raisable backrest cushion.

The features of the present invention which are believed to be novel are set forth with particularity in the appended claims. The present invention, both as to its organization and manner of operation, together with the further objects and advantages thereof, may be best understood by reference to the following description, taken in conjunction with the accompanying drawings.

BRIEF DESCRIPTION OF THE DRAWINGS

FIG. 1 is an isometric view of the therapeutic footrest of the invention.

FIG. 2 is an enlarged side-elevational view of the footrest, with parts broken away and parts taken in section.

FIG. 3 is a schematic electrical diagram of the electrical controls of the footrest of this invention.

DESCRIPTION OF THE PREFERRED EMBODIMENT

The therapeutic footrest of this invention is generally indicated at 10 in FIGS. 1 and 2. Its principal members comprise base 12, rest cushion 14 and back rest 16.

Base 12 has a square or rectangular base frame having front 18, right side 20, back 22, and left side 24. These sides are secured together to form a rigid base structure. Front and rear formers 26 and 28, as well as similar right and left formers, extend around the upper periphery of base 12 and are secured thereto. These formers define an overhang which is covered with plywood or the like, provides toe space 30 and adds decorative aspects to the footrest. The base is covered with appropriate material consistent with the overall appearance of the footrest. A flexible synthetic polymer composition material which serves as a substitute in appearance, texture and flexibility for leather can be employed. On the other hand, an upholstery fabric can be employed as the cover. Preferably, around the lower part of the former and the toe space 30, a stain- and scuff-resistant material can be used. For example, the lower covering 32 is preferably an aluminum facing which may be of sheet or extruded material, depending on the contours. This lower covering can be colored or glossy, depending on the application.

Rest cushion 14 has a structural support 34 which is hinged to former 28 by means of hinge 36. Support 38 is secured to structural support 34 and preferably has a thin wood skirt 40 depending therefrom. Cross member 42 strengthens the structure.

On top of support 38 is positioned resilient pad 44. On top thereof is positioned heating pad 46. On top thereof is positioned resilient pad 48. Both pads 44 and 48 can be formed of polyurethane foam material. The outer covering 50 is the upholstery layer and can be a synthetic polymer composition material which resembles leather in texture, flexibility, and color, or can be woven-typed of upholstery fabric. Preferably, it is the former type of material with a polyurethane foam backing. Upholstery covering layer 50 extends down the side of rest cushion 14, and is accordion folded at 52. It extends down over the outer skin of the formers to reach and extend under lower covering 32 for securement and appearance. It is thus seen that rest cushion 14 is pivotally mounted on base 12.

Toggle links 54 and 56 are respectively pivoted on cross member 42 and on cross member 58. They have their common ends pivoted on toggle nut 60 which is mounted on screw 62. Screw 62 is driven by tilt motor 64.

Vibrator motor 66 is secured on cross member 42. The electrical lines from heating pad 46, tilt motor 64 and vibrator motor 66 are brought together into juntion box 68. Furthermore, much of the electronic control equipment is in junction box 68. As is seen in FIG. 1, plug-in-wire 70 provides electricity to the therapeutic footrest, while the controls are positioned in control box 72 which is attached to the end of control box wire 74 which permits remote control of the therapeutic footrest.

As is seen in FIG. 3, electronic switch 76 is controlled by potentiometer 78 and temperature sensing thermistor 80. Thermistor 80 is positioned in the structure of heating pad 46 and senses its temperature. Switch 76, in turn, controls triac 82 which is in series with heating pad 46. Thus, potentiometer 78 and thermistor 80 control the current to the heating pad so that the heating level can be remotely selected.

Vibrator motor 66 is serially connected across the lines through manual offswitch 84 and triac 86. Triac 86 is controlled by electronic switch 88 which is, in turn, controlled by manual potentiometer 90. Triacs 82 and 86 are substantially in the form of opposed SCRs, while the electronic switches 76 and 88 are particularly suited for controlling them. Suitable electric switches are diac MBS-100. Manual switch 84 and potentiometer 90 are also carried on the remote control box 72.

Titl motor 64 is also connected between the lines and is provided with three-way reversing switch 92. In the center position, the reversing switch is off; while in the alternate ends positions, the reversing switch causes respective raising and lowering movement of rest cushion 14. Reversing switch 92 is also located on the portable control box 72. In this way, the footrest can be used in a plurality of modes at the same time, and the various combined features can be remotely adjusted even without requiring the user to remove his feet from the footrest. Each of the features can be independently adjusted so that the footrest angle, the footrest temperature, and the footrest vibration frequency can be individually adjusted to achieve the optimum combined therapeutic result.

Backrest 16 is shown in the raised position where it may be used as a heelrest when the calves of the user's legs extend across the top of rest cushion 14. Furthermore, footrest 10 can be employed as a seat, particularly when the upper section rest cushion 14 is in the lowered position with backrest 16 being used as a backrest for a sitting individual. When the raised position of backrest 16, as illustrated in FIGS. 1 and 2, is not desired, backrest 16 can be demounted from its bracket and remounted on lower bracket 94 where the upper edge of the backrest is even with the top surface of rest cushion 14. Thus, it is out of the way and unobtrusive. The backrest thus provides another dimension of function for footrest 10.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A therapeutic footrest comprising:

a base;

a rest cushion pivotally mounted with respect to said base and selectively operable motor means connected between said rest cushion and said base for moving said rest cushion to an angular orientation with respect to said base;

a heater in said rest cushion for selectively heating the top surface of said rest cushion;

a vibrator connected to said rest cushion for vibrating said rest cushion; and control means connected to said motor means and to said heater and to said vibrator for selectively controlling said motor means, said heater and said vibrator.

2. The therapeutic footrest of claim 1 wherein:

said control means includes a remote control structure so that a user of said footrest can control said footrest without removing his feet from said footrest.

3. The therapeutic footrest of claim 2 wherein:

said remote control structure comprises a control box, said control box being connected to said motor means, said heater and said vibrator through a flexible control wire so that said control box can be handheld while the user's feet are on said therapeutic footrest.

4. The therapeutic footrest of claim 1 wherein:

said motor means for angularly moving said rest cushion with respect to said base comprises first and second toggle links respectively pivoted to said rest cushion and said base, said toggle links being pivoted on a toggle nut, and a rest cushion control motor connected to move said toggle nut so that said rest cushion is angularly raised and lowered with respect to said base.

5. The therapeutic footrest of claim 4 wherein:

said rest cushion is hingedly mounted on said base.

6. The therapeutic footrest of claim 5 wherein:

a backrest is removably mountable on said rest cushion to serve as a backrest for a person sitting on said footrest.

7. The therapeutic footrest of claim 6 wherein:

said motor means is a reversible electric motor and a reversing switch is connected to control the direction of totation of said reversible electric motor to control the raising and lowering of said rest cushion with respect to said base, said reversing switch being part of said control means.

8. The therapeutic footrest of claim 6 wherein:

said heater in said rest cushion is an electric heater, and including a solid state electronic controller serially connected with said electric rest cushion heater, and a potentiometer in said control means for controlling the temperature of said rest cushion.

9. A therapeutic footrest of claim 6 wherein:

a thermistor is positioned adjacent said electric heater for sensing the temperature of said rest cushion and said thermistor is connected to also control said solid state electronic controller.

10. The therapeutic footrest of claim 1 wherein:

said heater in said rest cushion is an electric heater, and including a solid state electronic controller serially connected with said electric rest cushion heater, and a potentiometer is said control means for controlling the temperature of said rest cushion.

11. The therapeutic footrest of claim 10 wherein:

a thermistor is positioned adjacent said electric heater for sensing the temperature of said rest cushion and said thermistor is connected to also control said solid state electronic controller.

12. The therapeutic footrest of claim 11 wherein said vibrator is an electric vibrator and a solid state electronic vibrator controller is serially connected with said electric vibrator and a potentiometer is connected to control said solid state electronic vibrator controller, said vibrator control potentiometer being positioned in said control means so that vibrator frequency can be controlled.

13. The therapeutic footrest of claim 1 wherein:

said vibrator is an electric vibrator and a solid state electronic vibrator controller is serially connected with said electric vibrator and a potentiometer is connected to control said solid state electronic vibrator controller, said vibrator control potentiometer being positioned in said control means so that vibrator frequency can be controlled.

14. The therapeutic footrest of claim 6 wherein:

said vibrator is an electric vibrator and a solid state electronic vibrator controller is serially connected with said electric vibrator and a potentiometer is connected to control said solid state electronic vibrator controller, said vibrator control potentiometer being positioned in said control means so that vibrator frequency can be controlled.

15. The therapeutic footrest of claim 1 wherein:

said motor means is a reversible electric motor and a reversing switch is connected to control the direction of rotation of said reversible electric motor to control the raising and lowering of said rest cushion with respect to said base, said reversing switch being part of said control means.

* * * * *